United States Patent [19]

Besson et al.

[11] 4,420,263

[45] Dec. 13, 1983

[54] ELECTRONIC WATCH WITH MEANS FOR DETECTING THE MOVEMENT OF A HAND THROUGH A REFERENCE POSITION

[75] Inventors: Rene Besson, Neuchatel; Alphonse Bron, Bassecourt, both of Switzerland

[73] Assignee: ETA S.A., Fabriques d'Ebauches, Granges, Switzerland

[21] Appl. No.: 450,140

[22] Filed: Dec. 15, 1982

[30] Foreign Application Priority Data

Dec. 23, 1981 [CH] Switzerland ..... 8243/81

[51] Int. Cl.[3] ..... G04C 3/00; G04C 9/00; G04B 23/02

[52] U.S. Cl. ..... 368/80; 368/157; 368/187

[58] Field of Search ..... 368/76, 80, 155, 156, 368/157, 187

[56] References Cited

U.S. PATENT DOCUMENTS 4,091,612 5/1978 Meisner et al. ..... 368/155

4,119,892 10/1978 Saito et al. ..... 368/156 X 4,253,173 2/1981 Jaunin .

4,276,626 6/1981 Satoh et al. ..... 368/80

4,352,172 9/1982 Ueda et al. ..... 368/76

*Primary Examiner*—J. V. Truhe

*Assistant Examiner*—Terry Flower

*Attorney, Agent, or Firm*—Philip M. Hinderstein

[57] ABSTRACT

For performing a very precise detection of the position of at least one hand, the watch is provided with an electro-optical detection device.

The detection device comprises a wheel 8 carrying a mirror 26. The wheel 8 is intermittently driven by the driving member 6 for defining n angular positions of the mirror 26. The member 6 is meshing with the gear train 12 of the watch. It further comprises a light emitter 30 and a light receiver 32 which receives a light beam when the mirror 26 is in an angular position corresponding to the reference position of the hand. The number n is inferior to the number of steps performed by the hand during a complete revolution of said hand.

7 Claims, 11 Drawing Figures

ELECTRONIC WATCH WITH MEANS FOR DETECTING THE MOVEMENT OF A HAND THROUGH A REFERENCE POSITION

The present invention concerns an electronic watch provided with means for detecting the movement of a hand through a reference position. More precisely, the invention concerns an electronic watch of the type having hands, which comprises electrical-optical means for marking the time at which a hand or a plurality of hands move through a reference position.

In conventional electronic watches which have a display by means of hands, a time base supplies time pulses which serve to control a motor, the motor driving the hands by way of a gear train. The constant duration of the drive pulses is adjusted to such a value that, when the voltage supplied by the battery has the correct value, the electrical energy supplied to the motor in each pulse is sufficient to cause the hands to advance by one step, even during the intervals in which a calendar disc, if the watch is provided with one, is driven. This remains the case as long as the battery voltage remains higher than a given threshold. Therefore, if the battery is in good operating condition, at each time pulse supplied by the time base, the time display members advance by a corresponding amount.

However, irrespective of the precautions taken in regard to calculating and designing the motor, it will be appreciated that there is no mechanical connection between the stator of the motor, the coil of which receives the drive pulses, and the rotor which is mechanically connected to the gear train and thus to the time display members. Therefore, if a significant shock or impact is applied to the whole of the watch, the rotor may rotate through one or more steps in one direction or the other, without a drive pulse being applied to the coil. Alternatively, if a shock occurs when a drive pulse is being applied, that shock may prevent the motor from rotating or it may cause the motor to rotate in the wrong direction. To sum up, in all such circumstances, the position of the hands no longer corresponds to the internal time of the watch, that is to say, the drive pulses supplied by the time base. In order to remedy this operating defect, it is necessary to be able to make a periodic comparison between the real position of one or more hands and the position that the one or more hands should occupy in relation to the internal time of the watch.

In other electronic watches, at least one of the hands for displaying the time may be used to display other information such as the date of the month, the day of the week, etc. In this case, the motor is supplied upon demand by particular drive pulses which permit one or more hands to be moved opposite graduations of the dial, in order to display the one of the non-time items of information. Those drive pulses which have nothing to do with the time pulses are counted in drive pulse counters. In order to preserve the time information during such phases of displaying non-time informations, the time pulses are stored in counters associated with the time base. In order to return the hands to their position corresponding to the correct time display, after one of the above-mentioned display phases, comparators compare the time information and the information contained in the drive pulse counters. Drive pulses are applied to the motor until a condition of identity is obtained between the contents of the drive pulse and time pulse counters. The hands then again display the correct time information. The same problem arises if the analog watch has an alarm function (display of the alarm time) or a chronometric function. In all those situations, it is necessary to have absolute reference information relating to the position of the hands. This can be a signal which is supplied by a detector whenever one or more hands moves or move through a given position.

In some analog watches, the normal duration of the drive pulses is made such that the energy contained in each pulse is sufficient to cause the hands to advance by a corresponding number of steps, but is insufficent when the torque to be supplied by the motor increases, for example when driving the calendar disc. It will be appreciated that the duration of the drive pulses is increased when the motor torque rises. Such a solution is an attractive one as it permits the electrical energy supplied to the motor to be adapted to the mechanical energy that the motor is to supply. In order to detect that the electrical energy supplied has not been sufficient to cause the motor to rotate, one technique involves detecting, during or immediately after each pulse, whether the rotor has actually rotated. Such a detection step is effected directly or indirectly by measuring the induced voltage of the motor. Another detection method comprises periodically checking whether a hand, for example the second hand, is in fact moving through a reference position, at the time at which the drive pulse associated with the time information corresponding to that position appears. In the last-mentioned case, it is therefore again necessary to be able to mark the position of a hand at those precise times supplied by the time base of the watch.

It will be seen therefore that there are many designs of watches in which there is a need to be able to mark the position of one or more hands. It is for that reason that means for detecting the position of the hands are already being used in watches.

A first type of detection means used comprises a mechanically coupled cam which rotates synchronously with one or more hands. The cam closes an electrical contact at a precise angular position to cause an electrical pulse to be emitted. Such a detector has the advantage of being simple but it is not accurate and is generally not reliable. In addition, it can be used only with an unidirectional motor and it increases the energy which has to be supplied to the motor.

Another known detector is of the electrical-optical type. Such a detector is described in Japanese patent application No. 74834/80 published on Dec. 2, 1980. The watch comprises an electroluminescent diode which emits a light beam which passes through the dial, by way of a window. The hand carries a mirror on its inward surface. When the hand is in the reference position, the mirror reflects the light beam towards a phototransistor which thus detects the movement of the hand through the reference position. However, such a system has a poor degree of resolution, and its layout is not attractive from the aesthetic point of view.

SUMMARY OF THE INVENTION

In order to remedy those disadvantages, a first object of the present invention is to provide an electronic watch with hands and an electro-optical detector for detecting the movement of a hand through a reference position, which permits enhanced resolution and a high degree of reliability to be achieved.

A second object of the invention is to provide such a watch which further comprises means for comparing the time at which the hand moves through the reference position to the time at which such movement through the reference position should take place, in relation to an internal information of the watch, preferably the internal time, and for compensating for any advance or retard of the hands with respect to the internal information or internal time of the watch.

To attain those aims, the detection device comprises a movable detection member mounted pivotally about an axis and provided with a first optical device, a movable drive member connected to the gear train of the watch and co-operating with the detection member in order to impart successively to the first optical device n separate angular positions per revolution of the detection member, with $p=k\times n$ (p being the number of steps performed by the hand per revolution of the hand and k being an integer) and a second optical device which is fixed with respect to the body of the watch. The second optical device comprises at least a device for emitting a light beam towards the detection member and a light detecting device for receiving the emitted light beam only when the first optical device is in one or one of the n angular positions corresponding to the movement of the hand through the reference position or one of the reference positions.

BRIEF DESCRIPTION OF THE DRAWINGS

The invention will now be described in more detail, by way of example, with reference to the accompanying drawings, in which.

DETAILED DESCRIPTION OF THE PREFERRED EMBODIMENTS

The part of the watch to which the invention relates essentially concerns an optico-mechanical detection assembly which permits the movement of a hand through a reference position to be detected, and a circuit associated with the normal circuit of the watch, which permits use to be made of the information supplied by the detector, for possibly correcting the position of the hand in the event of absence of synchronization between the position of the hand and an internal control information, generally the internal time of the watch, as given by the time base.

Moreover, the invention may be applied to watches in which the hands are driven by a single motor, or watches in which the hands are driven by two motors, each motor driving for example one hand. In the particular example described, consideration is given only to detecting the position of the minute hand of a watch which does not have a second hand. It will be clear however that the invention could equally well be applied to the hour hand or the second hand.

Figure 1:
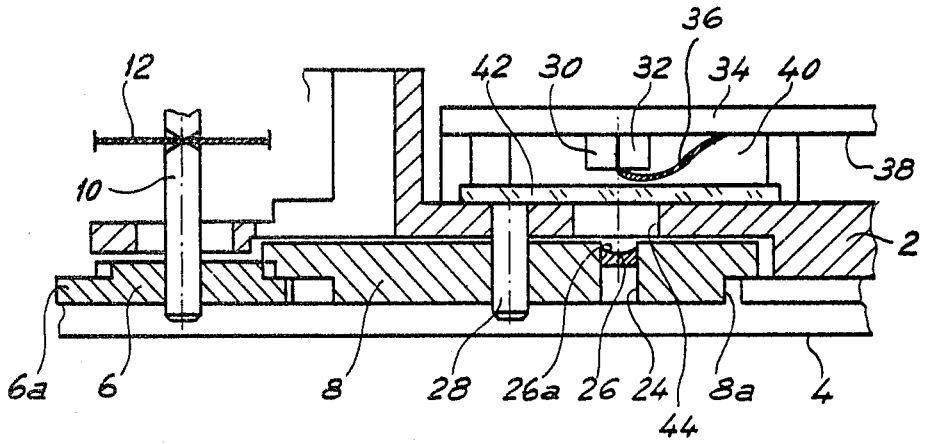
FIG. 1 is an elevational cross-sectional view of a part of a watch according to the invention, showing the device for detecting the movement of one hand through a reference position, the figure showing more particularly the mechanical part and the optical part of the detector.
Figure 2:
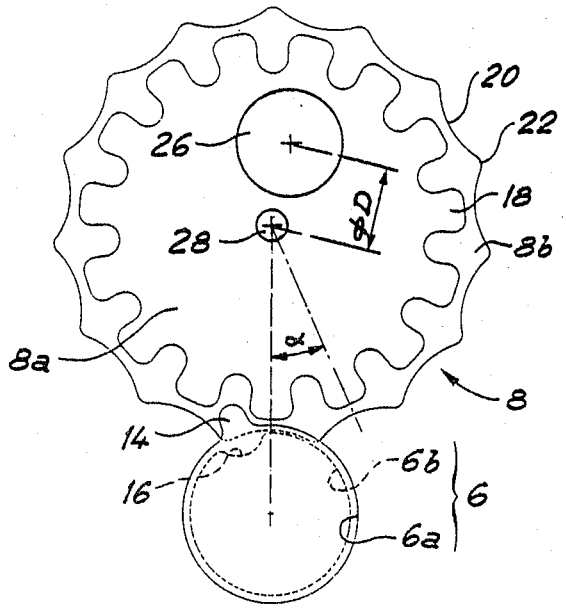
FIG. 2 is a plan view from above of the movable elements of the detector shown in FIG. 1, FIGS. 3*a* and 3*b* are simplified diagrammatic views illustrating two possible alternative embodiments of the optical part of the detector shown in FIG. 1.

Referring now to FIGS. 1 and 2, a first embodiment of the position detector proper will be described first of all.

FIG. 1 shows a part of the support structure 2 of the movement of the watch, line 4 diagrammatically indicating the dial. The detector comprises a movable assembly formed by wheels 6 and 8. The wheel 6 is non-rotatably fixed to a spindle 10 which is mounted pivotally in the structure 2 and which further carries a toothed pinion 12 engaging with the remainder of the gear train for driving the hands. The wheel 6 comprises a first disc-shaped portion 6*a* which is provided with a drive finger 14 (FIG. 2) on its periphery. The wheel 6 comprises a second portion 6*b*, which is also in the form of a disc, the diameter of which is less than that of the portion 6*a*. The portion 6*b* is provided on its periphery with a notch or recess 16 which has a radial axis of symmetry which is coincident with the axis of symmetry of the finger 14. The wheel 8 also comprises a first portion 8*a* which is provided around its entire periphery with n teeth 18 capable of co-operating with the finger 14. The member 8 further comprises a second portion 8*b*, which is also in the form of a disc, the diameter of which is larger than that of the portion 8*a*. The whole of the periphery of the portion 8*b* is provided with concave cylindrical surface portions 20 which are separated from each other by edges or ridges 22. Each concave portion has the same plane of symmetry as the tooth 18 associated therewith. Finally, the wheel 8 has a single aperture 24 into which a mirror 26 is fitted. The reflecting surface 26*a* of the mirror 26 is a portion of a sphere or preferably a slightly ovalised portion of a sphere. As can be seen from FIG. 2, the centre of the mirror is disposed on a radius which forms an axis of symmetry in respect of one of the teeth 18. The whole of the wheel 8 is fixed with respect to a spindle 28 which is mounted pivotally in the structure 2.

In a vertical plane, the wheel portions 6*a* and 8*a* are disposed at the same level. The same also applies in regard to the portions 8*b* and 6*b*. The radius of the portion 6*b* of the wheel 6 is substantially equal to that of the cylinder defining the cylindrical surface portions 20 of the member 8. In addition, the distance between the axes of the members 6 and 8 is such that each lateral surface portions 20 of the portion 8*b* of the wheel 8 can mate with the circumferential surface of the portion 6*b* of the wheel. It can readily be seen that, in the phases of mutual engagement, the finger 14 acts on one of the teeth 18 and causes the member 8 to rotate through an angle which is 360°/n. That rotary movement is possible because during the drive phase, a ridge 22 can temporarily engage into the recess 16. In contrast, outside the drive phases, the co-operation of the lateral surface of the portion 6*b* of the member 6 with a cylindrical portion of the member 8 locks the member 8 against rotary movement, while permitting free rotary movement of the member 6.

The detection assembly further comprises a light source 30 which is preferably formed by a diode which emits light in the infrared, and a light detector or pick-up 32 which is formed for example by a phototransistor. Those components are fixed on a support 34 and electrically connected, by means of electrical conductors diagrammatically indicated at 36, to a printed circuit 38 fixed on the support 34. The printed circuit 38 is connected to the integrated circuit of the watch by any suitable means. The connection 36 represents the conductors for feeding power to the electroluminescent diode 30, the biasing conductors of the phototransistor 32 (or the photodiode) and the conductors for collecting the signal supplied by this light detector (phototransistor) in response to the light beam applied thereto. The detection assembly 30, 32 is for example disposed in a housing 40 which is closed by a transparent panel 42. A window 44 is provided in the support structure 2 to permit the incident and reflected light beams to pass therethrough. It will be clearly seen that the light detector 32 receives a light signal only if the electroluminescent diode 30 is excited and the mirror is disposed facing the light emitter 30 in such a way that it returns a significant part of the incident light beam towards the detector 32.

By way of example, the outside diameter of the wheel 8 is 4 mm, which does not take up a substantial amount of space in the watch. The reflecting surface **26*a* of the mirror 26 is a portion of a sphere, with a diameter of 1 mm. The wheel 8 has 15 teeth (n=15). The wheel 8** therefore performs 15 steps per revolution.

In spite of the small dimension indicated above, there is only a slight amount of overlap between the different positions successively occupied by the mirror. That result, combined with the concavity of the mirror, means that the light signal collected by the light detector 32 is significant only when the mirror is in one position.

In the example under consideration herein, the motor driving the minutes and hours hands performs 120 steps per hour, that is to say, per revolution of the minute hand around the dial. With the wheel 8 performing 15 steps per revolution, that is to say, per hour, the wheel 6 must perform one revolution every four minutes, that is to say, one revolution for eight steps of the motor. The wheel 6 must be mounted in the gear train in such a way that it is actually moving at that speed of rotation. The mirror 26 is therefore displaced every four minutes, that is to say, every eight steps of the motor. The duration of the phase of interengagement between the members 6 and 8 corresponds to two steps of the motor, in the example being considered herein. It will be appreciated that in other embodiments, the time of interengagement between the movable members could be equal to one step of the motor.

The fact that the wheel 8 performs only 15 steps instead of 120 steps per revolution of the hand is a very substantial advantage in regard to the degree of resolution of the system, while permitting the diameter of the wheel 8 to be limited. In fact, for a given diameter of the reflecting surface **26*a* of the mirror, it is possible to reduce the diameter D of the circle on which the mirror is centering, since reducing the number of steps performed by the wheel 8 per revolution increases the angle at the centre, between two successive positions of the centre of the mirror. The assembly formed by the wheels 6 and 8** therefore behaves like a mechanical rotary movement amplifier means, with respect to the prior-art arrangements. That makes it possible of the hand is detected, without increasing the amount of space taken up by the mechanical part of the detection arrangement.

The above-indicated value n=15 corresponds to a good compromise between the degree of resolution for given dimensions of the movable members, and the torque which is required to rotate the wheel 8. Moreover, it is readily possible to drive the wheel 6 at eight motor steps per revolution. However, it would be possible to envisage other ratios. Broadly, the relationship is: $p=k\times n$, in which p is the number of steps of the hand for making one revolution around the dial, and k is the number of steps of the motor required for the wheel 6 to perform one revolution. It will be appreciated that it is essential that n be higher than or equal to two in order for detection to take place. In fact, it must be markedly higher than two in order for the locking action as between the members 6 and 8 to be technologically possible. Likewise, n must be less than pin order for the amplification effect to occur. In actual fact, in order to achieve an improvement in resolution, the number n must be substantially lower than p.

Another possible way of enhancing resolution without increasing the dimensions of the wheel 8 comprises providing that the wheel 8 performs a number of revolutions per revolution of the hand around the dial. If q is the number of revolutions of the member 8 per revolution around the dial, and n' is the number of steps of the member 8, the relationship is as follows:

$$p=k\times(q\times n')$$

It will be appreciated that, in that case, movement of the mirror 26 in front of the optical detector corresponds to q different positions of the hand. In this case there are q reference positions for the hand. Such a detector does not therefore permit initialization of the position of the hand, when the detector is in the form described.

Figure 3A:
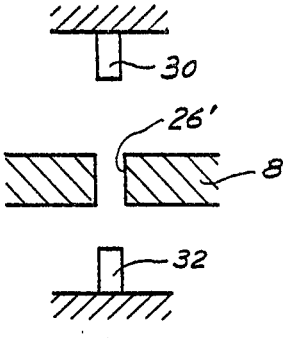
Figure 3B:
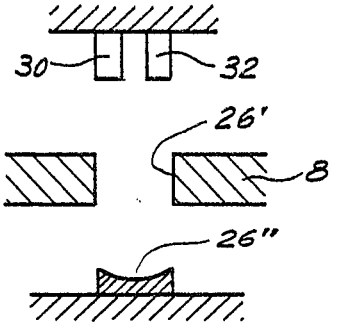

It is also possible to provide other optical systems for carrying out the detection step. FIGS. **3*a* and 3*b* show two alternative forms of the optical system shown in FIG. 1. In FIG. 3*a*, the mirror 26 is replaced by a diaphragm 26' provided in the wheel 8. The emitter and the receiver, at 30 and 32, are disposed on respective sides of the movable member 8, and are coaxial. In FIG. 3*b*, the detector 32 and the emitter 30 are disposed side-by-side and on the same side with respect to the wheel 8. The wheel 8 is apertured with a diaphragm 26' and a concave 26'', identical to the mirror 26 in FIGS. 1 and 2, is disposed facing the emitter and the detector, the mirror 26'' and the detector-emitter assembly being disposed on respective sides of the wheel 8**. These two constructions suffer from relative disadvantage of increasing the overall thickness of the arrangement.

In any case, the emitter and the receiver are fixed and an optical device formed by a mirror or a diaphragm is fixed with respect to the wheel 8, that device permitting the light beam to reach the detector only if it is in an angular position corresponding to movement of the hand through the or a reference position.

The mode of operation of the detector proper will be apparent from the foregoing description. While the electroluminescent diode 30 is supplied, it emits a light beam towards the wheel 8. As long as the mirror 26 is not in front of the emitter 30, the phototransistor does not receive any light or at least does not receive any significant light. It therefore does not produce a detection signal. In contrast, if the mirror is opposite the emitter 30, the receiver 32 receives a reflected light beam at a significant level, and it produces a detection signal.

Figure 8A:
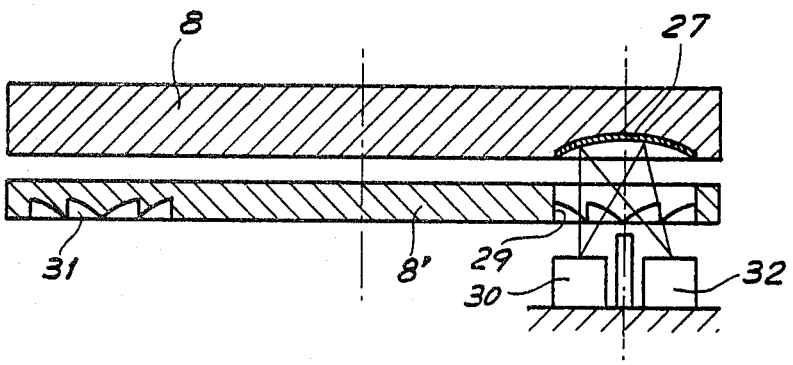
FIGS. 8*a* and 8*b* show two alternative embodiments of the detection device for detecting the movement of two hands through a reference position.
Figure 8B:
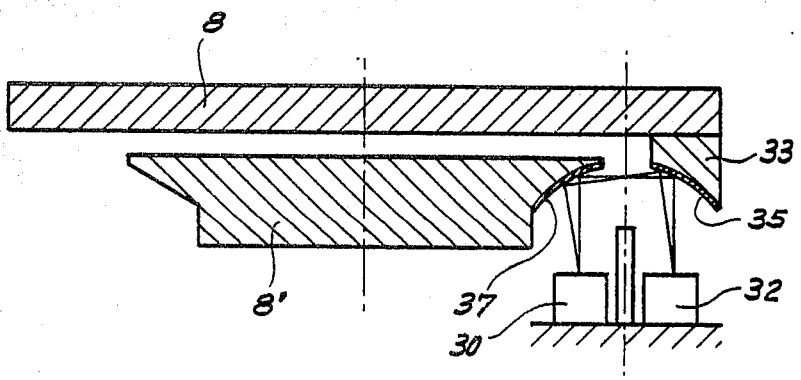

Referring now to FIGS. 8*a* and 8*b* there is shown alternative embodiments of the detector, in the situation where the detection step takes place when two hands of the watch are in a given position, for example when the hours hand and the minutes hand are both in the 12 o'clock position on the dial.

In the alternative embodiments shown in FIGS. 8*a* and 8*b*, the arrangement again includes the wheel 8 which is driven by the wheel 6 which rotates at the same rate for example as the minutes hand. The detector comprises a second wheel 8' which is rotable about the same axis of rotation as the wheel 8 and which is kinematically connected to the movement of the hours hand. The wheel performs one revolution per revolution of the minutes hand, while the wheel 8' performs one revolution or half a revolution per revolution of the hours hand. More generally the hours hand performs m revolutions per revolution of the wheel 8' ($1<m<3$). Depending on this choice, detection will take place each time that the two hands are at the 12 o'clock position or each alternate occasion that the hands move through the 12 o'clock position. In the second case, it will be appreciated that a distinction is made between midday and midnight.

In the embodiment shown in FIG. 8*a*, the wheel 8 comprises a mirror 27 having a reflecting surface 27*a* which is concave and directed towards the wheel 8'. The wheel 8' is provided with a hole 29, the centre of which is disposed at the same distance from the axis of rotation as the centre of the mirror 27. The arrangement again comprises the light source 30 and the light detector 32, which are fixed with respect to the support structure of the watch. The wheel 8' is mounted between the wheel 8 and the emitter-receiver assembly 30–32. It will be readily appreciated that, as long as the wheel 8' is not in the reference position, the wheel 8 does not receive any light. When the aperture 29 is at least partially opposite the emitter, the wheel 8 receives light, but the light is not reflected. It is only when the two hands are at the reference position that the mirror 27 and the hole 29 are disposed one above the other and opposite to the light emitter. In order to ensure that reflection of the light by the lower surface 8'*a* of the wheel 8' cannot cause spurious actuation of the receiver 32, the portion of the surface 8'*a* which passes in front of the emitter is provided with ribs or flutes 31 which diffuse the light emitted by the emitter 30 away from the sensitive surface of the receiver.

FIG. 8*b* shows another embodiment of the optical system. On its periphery, the wheel 8 comprises a support 33 for a concave mirror 35 extending over a reduced sector of the wheel 8. The wheel 8' carries a second concave mirror 37, over a reduced sector of its periphery. When the two hands are at the reference position, the two mirrors 35 and 37 are facing each other. Their optical parameters are such that, in that configuration, and in that configuration alone, the beam produced by the light source 30 is returned towards the receiver 32.

Broadly speaking a detection signal is emitted when both the optical device of the wheel 8 is in that or those of the n positions corresponding to the minutes hand reference positions and the optical device of wheel 8' is in an optical relationship with the optical device of wheel 8. Obviously, in an alternative embodiment the wheel 8 may co-operate with the seconds hand and the wheel 8' with the minutes hand.

A remark should be made at this juncture, concerning the mode of operation and the electrical power consumption of the detector. It is obvious that, in a watch, the level of electrical power consumption should be reduced as much as possible, in order to increase the service life of the battery for supplying the watch with power. Now, a photodiode has a high level of consumption, in terms of a watch. It is therefore an attractive proposition to limit the time for which the diode 30 is supplied with power. In the particular case described, the time of interengagement between the members 6 and 8 corresponds to two steps of the motor. Between those two steps, the wheel 8 is in an uncertain position. More generally, the interengagement time T is $x \cdot t$, x being an integer and t being the time taken by the hand to cover one step. In the particular case described, the value of x is 2. On the other hand, the motor performs 120 steps per hour, for the minute hand. The drive pulses are alternatively positive and negative. It is easy to arrange that an even drive pulse (positive pulse) moves the minute hand to a graduation in respect of the minutes, and a negative drive pulse moves the minute hand into an intermediate position between two successive minute graduation marks. Likewise, it is possible to provide that the end of a phase of interengagement of the wheels 6 and 8 coincides with a positive drive pulse. It will be appreciated that the reference position is so selected as to coincide with a minute graduation, for example the zero graduation. Consequently, the emitter 30 only has to be supplied with power for a time $t_o$ after each positive drive pulse.

Figures 6, 7A, 7B:
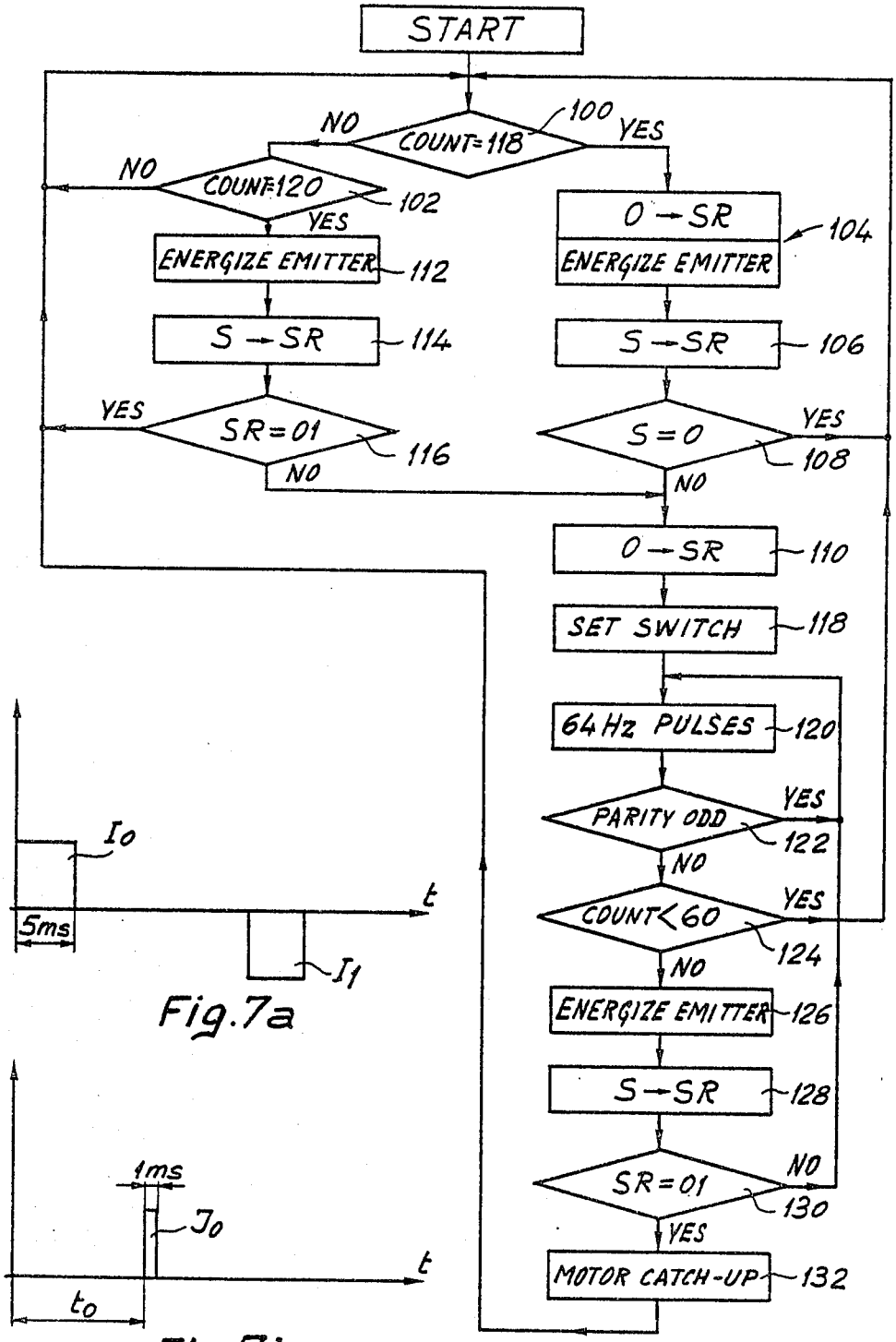
FIG. 6 shows a flow chart explaining the mode of operation of the circuit according to the invention for correction the position of the hands and possibly for initializing the position of the hands.
FIGS. 7*a* and 7*b* are time diagrams illustrating the manner in which the detection times are defined.

FIGS. 7*a* and 7*b* illustrate actuation of the emitter 30, $I_o$ and $I_1$ representing two drive pulses which are respectively positive and negative. In normal operation, they are displaced by 30 seconds. They are for example of a duration of the order of 5 ms. $J_o$ represents the diode supply pulse. The duration of that pulse is for example 1 ms and the delay $t_o$ is 12 ms. In this way, the number of times that the diode is supplied with power is reduced, and the duration of each supply period is short.

In the description below, the value "1" will be assigned to the signal supplied by the detector 32 when the mirror 26 is opposite the emitter 30, and the value zero will be assigned in the opposite situation.

Before describing in detail the circuits which make it possible to check that the position of the minutes hand does in fact correspond to the internal time of the watch, the basic principle thereof will be briefly described. In the case of the embodiment of FIGS. 1 and 2, detection is effected in each normal revolution of the minutes hand. The emitting diode 30 is supplied with power at the times 59 minutes and 60 minutes defined by the time base of the watch, the reference position being the zero graduation. This therefore produces a number of two binary digits, the right-hand digit giving the value of the detection signal at the 60th minute and the left-hand digit giving the value of the signal at the 59th minute. Detection takes place at the 59th and 60th minutes because the interengagement time corresponds to two motor steps ($x=2$), that is to say, one minute. If the mechanism were so arranged that the interengagement lasts for only a single motor step, detection would take place at the 60th minute and at 59 minutes 30 seconds. If the number is 01, that means that the hand did in fact pass through the reference position at the 60th minute. The hand is therefore properly synchronized with the time base.

If the number is 00, the hand is lagging or it is in advance by at least 5 minutes. In fact, the mirror rotates only every eight motor steps, that is to say, every four minutes.

If the number is 11, this means that the hand is in advance by one, two or three minutes. The fact that there are three possible values is due to the fact that the movable member 8 only moves every four minutes.

If the number is 10, this means that the hand is also in advance, by precisely four minutes.

Figure 4:
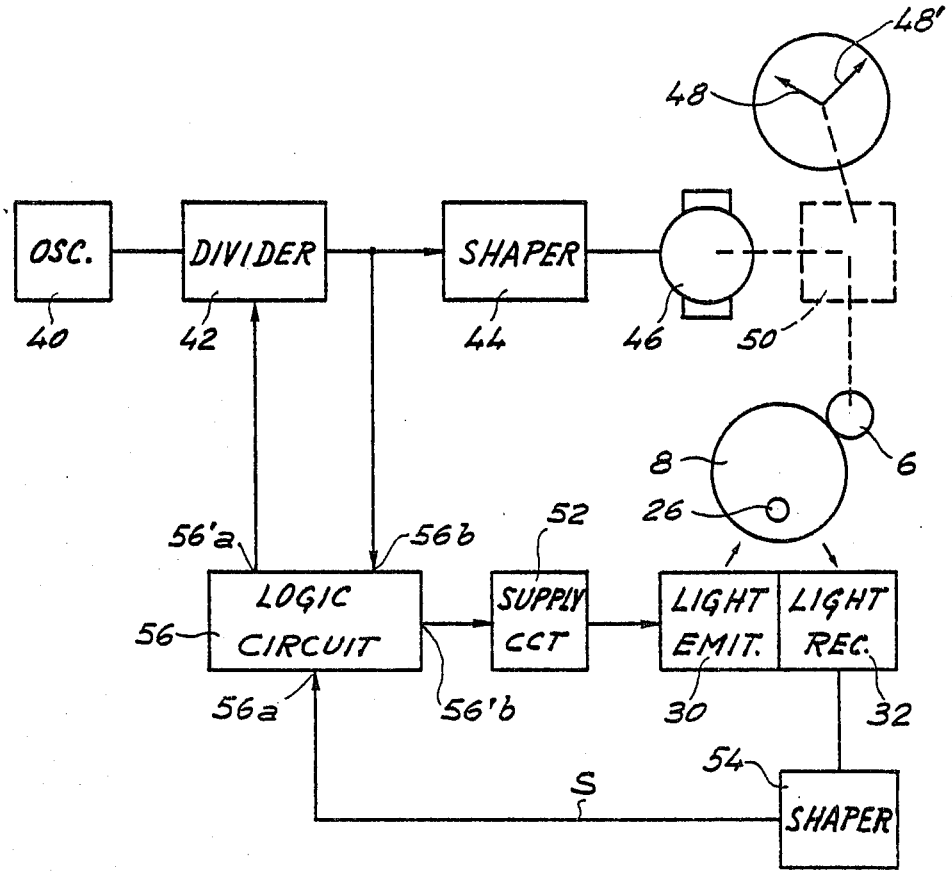
FIG. 4 is a simplified diagrammatic view of the part of the circuit of the watch which provides for possibly correcting the position of the hand in dependence on the data supplied by the position detector.

In any case where the number is different from 01, alternate drive pulses at high frequency, for example a frequency of 64 Hz, are applied to the motor. The detection operation is carried out after each positive drive pulse. When the number 01 is obtained, that means that the minute hand is passing through the reference position. The minute hand and the time base are synchronized. The missing drive pulses are supplied, if necessary. If, for an accidental reason, after 60 positive drive pulses, the number 01 is not produced, the application of the rapid pulses is stopped in order to avoid discharging the watch battery. FIG. 4 shows the general layout of the part of the circuit of the watch which permits the position of the minutes hand to be re-adjusted to the internal time given by the time base of the watch.

FIG. 4 shows the oscillator 40 of the watch, which produces a periodic signal for example at a frequency of 32768 Hz, in conventional manner. The periodic signal is fed to a frequency divider 42 which can produce at least one periodic signal. In the example being considered, the frequency of the signal is selectable between 1/30 Hz and 64 Hz. The periodic signal is applied to the input of the shaper or driver circuit 44 which applies alternate drive pulses at that frequency, to the stepping motor 46. The motor 46 drives one or two hands 48, 48' which are provided for example to display minutes and hours, by means of a gear train diagrammatically indicated at 50. As already described above, the gear train 50 also drives the wheel 6. That causes the wheel 8 which carries the mirror 26 to advance by one step, every four minutes. Associated with the wheel 8 are the light emitter 30 and the light receiver 32. As already described, the emitter 30 is controlled by a supply circuit 52 which determines the moment of excitation of the emitter 30 and the duration and the shape of the excitation pulse (for example 1 ms). The current or voltage produced by the detector 32 is shaped in a circuit 54, to produce a logic signal S. As already described above, the value of the signal S is 1 if the mirror is facing the emitter-receiver assembly, and 0 in the opposite situation. A logic circuit 56 controls performance of the process of synchronizing the position of the minutes hand with the internal time of the watch as given by the frequency divider 42. For that purpose, the logic circuit 56 receives, at its inputs **56*a* and 56*b*, the logic signal S and the periodic signal from the frequency divider 42. At its output 56'*a* it produces a signal for controlling the frequency supplied by the divider 42, while at its output 56'*b* it generates a signal for controlling the supply circuit 52**.

Figure 5:
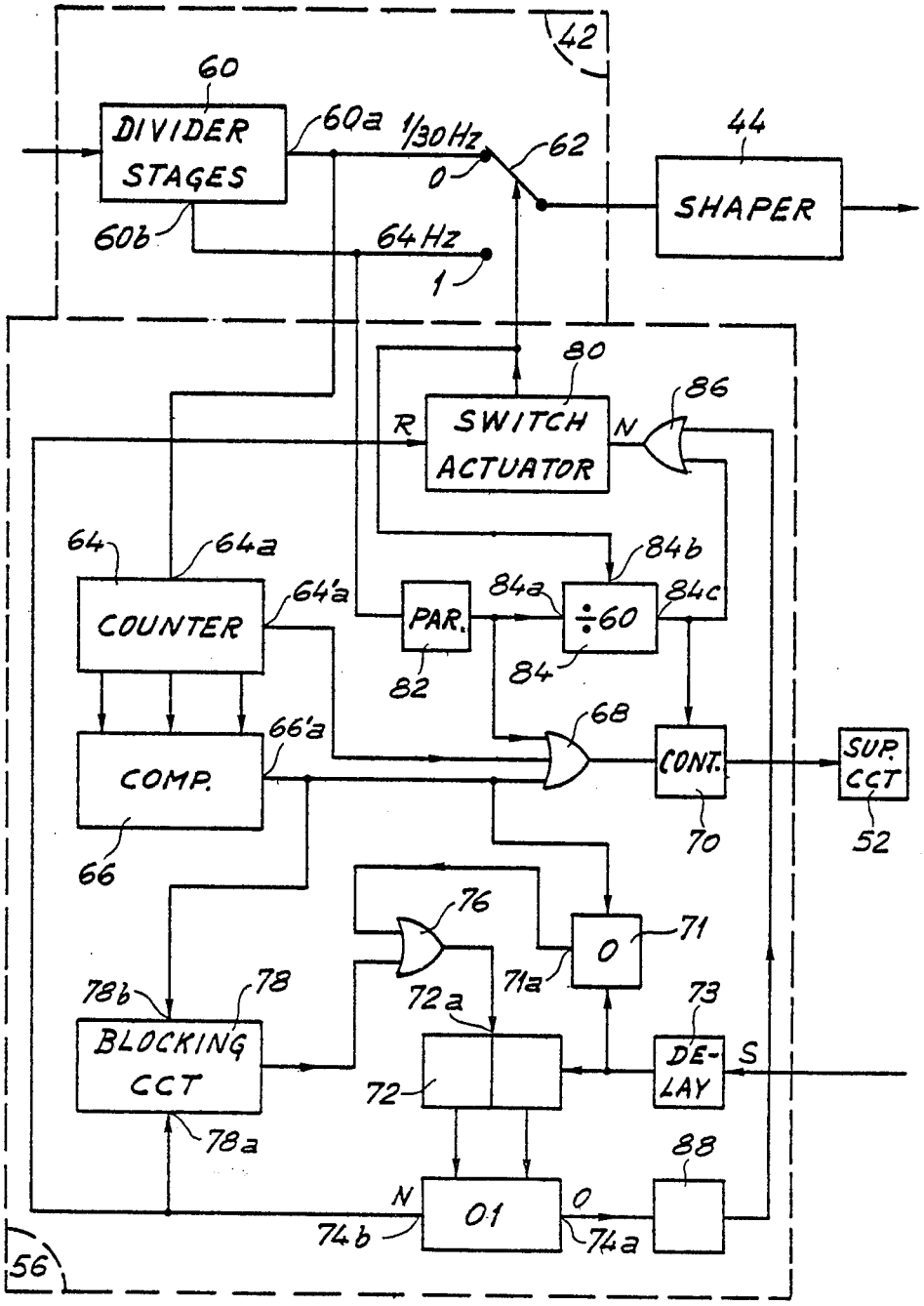
FIG. 5 is a more detailed diagrammatic view of the logic control assembly of the circuit shown in FIG. 4.

FIG. 5 shows in greater detail the layout of the logic circuit 56 and the various associated circuits.

The frequency divider 42 is formed by a plurality of divider stages 60. At an output **60*a*, they produce a signal at a frequency of 1/30 Hz for normal actuation of the motor, while at an output 60*b*, they produce a signal at a frequency of 64 Hz, for driving the motor at high speed. The outputs 60*a* and 60*b* are connected to the circuit 44 by way of a controllable change-over switch 62. It will be realized that the switch 62** is in fact formed by semiconductor components, for example complementary MOS transistors.

The logic circuit 56 comprises a counter 64, for counting up to 120. At its clock input **64*a*, the counter 120 receives the 1/30 Hz frequency signal. At its output 64'*a*, the counter 64 produces a pulse each time that it has counted 120 pulses applied to its clock input. The counter 64 is associated with a comparator 66 which continuously compares the content of the counter 64 to the value 118. The comparator produces a signal at its output 66'*a* when the content of the counter 64 goes to 118. It will be appreciated that the comparator 66 produces a signal for each 59th minute, and the counter 64 produces a pulse for each 60th minute. The outputs 64'*a* and 66'*a* are connected to two inputs of an OR-gate 68. The output of the gate 68 is applied to a circuit 70 for controlling the supply circuit 52 of the emitter 30**.

The circuit 56 also comprises a two-bit shift register 72 with a zero resetting input **72*a*. The register 72 is supplied from the output of the circuit 54 for shaping the signal supplied by the receiver 32, by way of a delay circuit 73, the time constant of which is of the order of 1 ms. A zero comparator 71 also receives the signal from the circuit 73. The comparator 71 is activated only upon the appearance of the signal supplied by the comparator 66. Its only function is therefore to compare to zero the value of the signal S resulting from the detection operation at the 59th minute. It produces a signal at its output 71*a*, if the value at its input is zero. The register 72 is associated with a digital comparison circuit 74 which compares the state of the register 72 to the number 01 at the moment at which the emitter is supplied with power. If the content of the register 72 is equal to 01, the circuit 74 produces a signal at its output 74*a*, while in the opposite situation, it produces a signal at its output 74*b*. It will be clearly seen that the purpose of the register 72 is to store the last two values of the detection signal S. The output 74*b* of the comparator 74 is connected to an input of an OR-gate 76, by way of a blocking circuit 78. The purpose of the circuit 78 is to allow only a single pulse applied to its input 78*a* to pass, as long as there is no unblocking pulse applied to its control input 78*b*. The control input 78*b* is connected to the output 66'*a* of the comparator 66. The OR-gate 76 receives the signal supplied by the comparator 71, at its second input, and the output of the gate 76 is connected to the resetting input 72*a* of the register 72**.

The change-over switch 62 is actuated by a circuit 80. The circuit 80 produces a signal at level 0 which switches the switch 62 into the position 0 if a signal is applied to its input N. It produces a signal at level 1 which switches the switch 62 into position 1 of a signal is applied to its input R. In other words, if the input N of the circuit 80 is supplied with power, the driver circuit 44 receives pulses at an elevated frequency of 64 Hz. The logic circuit 56 further comprises a parity detector 82 which is connected to the output **60*b* of the divider 60. It allows the pulse applied to its input to pass only if it is an even pulse, that is to say, if it causes a positive drive pulse to be applied to the motor. The output of the detector 82 is connected on the one hand to an input of the OR-gate 68 and on the other hand to the clock input 84***a* of a counter 84 for counting in 60*s*. In addition, the counter 84 comprises a zero resetting input 84*b*. The input 84*b* is connected to the output of the control circuit 80 in such a way that the counter 84 is kept at zero as long as the circuit 80 holds the switch 62 in position 0. In other words, the counter 84 counts the even pulses of the 64 Hz signal only when they are applied to the driver circuit. The output 84*c* of the counter 84 which produces a pulse each time that 60 even pulses are counted, is connected to an input of an OR-gate 86, the output of which is connected to the input N of the control circuit 80. That output is also connected to the circuit 70 for controlling the power supply to the emitter, in order to prevent the emitter from being supplied with power. The other input of the gate 86 is connected to the output 74*a* of the comparator 74 by way of the computing circuit 88. Finally, the output 74*b* of the comparison circuit 74 is connected to the input R of the circuit 80 for controlling the switch 82.

The same type of circuit may be associated to the detector device of FIG. 8*a* or 8*b*.

The mode of operation of the circuit shown in FIG. 5 will now be described with reference to the flow chart shown in FIG. 6. The normal pulses at a frequency of 1/30th Hz, which are counted by the counter 64, are compared to the value 118 by the test indicated at 100 (comparator 66). If the number of pulses is different from 118, it is compared to 120 by the test 102 (counter 64). If the number is also different from 120, the procedure returns to the input of the test 100. That means that the 59th minute has not yet been reached. If the number of the pulse is equal to 118, at step 104 the shift register 72 is set to zero (the content of the register being referred to as SR in the flow chart) and the emitter 30 is supplied with power. The value of the signal S supplied by the detector 32 is loaded into the register 72 at 106. The value of the signal S is tested at 108. If S=0, the procedure returns to the input of the test 100. If S is different from 0, the procedure goes to step 110. In fact, in that situation, it is certain that the binary value will not be 01. The register 72 is reset to zero at 110.

If, at step 102, the number of the 1/30th Hz pulse is equal to 120 (60th minute), the emitter is supplied with power at 112 and the value of the signal S supplied by the detector 32 is introduced into the register 72 during step 114. In step 116, the content SR of the register 72 is compared to 01, that operation being performed by the comparator 74. If the value of SR is 01, the procedure returns to the test operation 100. In effect, that means that the minutes hand is properly in phase with the internal time of the watch. If on the other hand SR is different from the value 01, the procedure goes to operation 110, which comprises resetting the register 72 to zero. That operation is performed by the gate 76 and the circuit 78 which is not in a blocking condition since it is the first time that a comparison is being made. As SR is different from 01, a signal is applied to the input R of the circuit for controlling the switch 62. It is therefore pulses at a frequency of 64 Hz, that are applied to the circuit 44. Those operations are symbolically indicated by references 118 and 120 in FIG. 6. In step 122, the parity of the rapid pulse is tested (circuit 82). If the pulse is odd, the procedure returns to operation 120. If the pulse is even, the number thereof is compared to 60 during the operation 124. In specific terms, that comparison step is carried out by the counter 84. If the number of the pulse is equal to 60, the procedure returns to the starting operation 100. That indicates that the positional error of the hand has not been corrected, but nonetheless the correction operation is stopped in order not to wear out the battery. That instruction is indicated by the fact that the circuit 80 receives a signal at its input N. The pulses at a frequency of 1/30 Hz are therefore re-applied to the motor. If the number of the even pulse is less than 60, the emitter 30 is supplied with power (operation 126) and the corresponding value of the signal S is loaded into the register 72, at step 128.

The fresh content is compared to the value 01 (operation 130). That is effected by the comparator 74. If the content is different from 01, the procedure returns to step 120, that is to say, a fresh rapid pulse is processed. As this is not the first comparison operation, the circuit 78 is in a blocking condition and the register 72 is therefore not reset to zero. On the other hand, it is still the rapid pulses which are applied to the circuit 44 since it is at its input R that the control circuit 80 receives a pulse. If on the other hand the content of the register 72 is equal to 01, the circuit 80 receives a pulse at its input N. It is therefore again pulses at a normal frequency that are applied to the driver circuit 44. The circuit 88 computes the number N of pulses to be applied to the motor in order to bring the hand precisely into phase with the internal time of the watch (operation 132). When the value of the rapid frequency is 64 Hz, the maximum duration of the correction operation is 2 seconds. The generator 60 does not emit any time pulse during the period of the correction operation. The minutes hand therefore had to remain at the graduation mark 60. The computing circuit 88 is therefore not operative and the value of N is zero. When it is the seconds hand which is to be re-adjusted, the time signal may be at a frequency of 2 Hz. If the high-frequency signal is at a frequency of 64 Hz, in which case the correction operation can require 120 motor steps, the duration of the correction operation may be about 2 seconds. During that period, the generator 60 has produced a number of time pulses, and therefore the hand will no longer occupy position 0, but a different position. The circuit 88 computes the number N of time pulses supplied and passes N additional rapid pulses to the driver circuit 44. This is denoted MOTOR CATCH-UP. It should be added that the optical detection operation is performed every two periods of the signal supplied by the frequency generator 42, whether it is the signal at a frequency of 1/30th Hz or the signal at a frequency of 64 Hz. More generally, if the time of interengagement of the two wheels 6 and 8 corresponds to x steps of the motor, the detection operation will be effected every x periods of the periodic signal that is actually applied to the motor (1/30th Hz or 64 Hz).

In the above-described correction procedure, the control or monitoring operation is performed when the minutes hand is driven at its normal speed, that is to say, by pulses at a frequency of 1/30th Hz. However, it is known to use a hand or the hands to display informations other than the present time. Thus, it is possible to display an alarm time, the date, the month, etc. For that purpose, the watch comprises memories or counters which contain information representing the position that the hand is to occupy in order to display the selected item of information.

For the purposes of driving the hand into that position, one design involves applying rapid pulses, for example at a frequency of 64 Hz, to the motor. The number of pulses to be applied is determined on the basis of the content of the memory storing the position of the item of information to be displayed, and the content of the counters counting the present time. In performing the rapid movement, the hand may move through the reference position. It is advantageous to be able to check the real position of the hand against its theoretical position, in the rapid-movement phase referred to above. It will be readily seen that the problem is substantially the same one. One difference is that the correction signal which is possibly to be applied and the motor control signal are at the same frequency. That is of no importance. Another difference lies in the manner in which the moments at which the monitoring operation is to be performed are produced. In fact, in that case, such moments can no longer be determined on the basis of the counter 64 of FIG. 5 which is only incremented by the time base pulses, and the comparator 66. It is sufficient to ensure that the counter 64 is incremented by the time base pulses during the normal mode of operation, and by the 64 Hz pulses during the rapid movement phase. In this way, the circuits 66 and 64 will actually supply detection pulses for the 118th motor control pulse and for the 120th pulse. In this situation the steps described with reference to FIGS. 5 and 6 are performed. When the hands return to the position for displaying the present time, the rapid pulses continue to be applied to the input of the counter 64 until the hands are in the desired position. The time base pulses at a frequency of 1/30th Hz are then again applied to the counter 64.

It will be appreciated by those skilled in the art that the circuit shown in FIG. 5 is only given by way of example of a possible embodiment, using discrete logic circuits. The flow chart of FIG. 6 shows that the circuit 56 could equally well be formed by means of a microprocessor.

It will be apparent from the foregoing description that the detector proper, in accordance with the invention, effectively solves the problem of locating the position of the hand in a watch. It has a high level of resolution, that is to say, there is no danger of error in the detection operation, between two successive angular positions. However, the whole of the detector is of reduced dimensions, which make it easy to house in the movement of the watch.

Various other modifications of the present invention will be apparent to those skilled in the art, and it therefore is intended that the scope of the present invention be limited solely by the scope of the appended claims.

What is claimed is:

1. An electronic watch comprising a frequency generator for supplying at least one periodic signal, stepping motor means controlled by said signal, at least one hand for displaying the time and performing p steps per revolution, a gear train for transmitting the movement of said motor means to said hand and means for detecting the movement of said hand through at least one reference position, comprising:

a movable detection member mounted pivotally about an axis and provided with a first optical device;

a movable drive member connected to said gear train and co-operating with said movable detection member in order successively to impart to said first optical device n separate angular positions per revolution of said movable detection member with $P>n\geqq 2$ and $P=k\times n$, k being an integer;

a second optical device which is fixed comprising at least means for emitting a light beam towards said movable detection member and light detecting means for receiving at least a part of said light beam only when said first optical means is in those of said n positions corresponding to said reference positions of said hand and for converting said light beam into an electrical signal; and means for delivering a detection signal in response to said electrical signal.

2. A watch according to claim 1 wherein said second optical device consists in said light emitting means and said light detecting means, which are both disposed on the same side of said movable detection member, and said first optical device comprises a mirror mounted on the face of the movable member which is directed towards said emitter and said detector, said mirror returning the light beam emitted by said emitter towards said detector only in said angular position.

3. A watch according to claim 1 wherein said movable drive member comprises a single drive finger on its periphery, said movable detection member comprises on its periphery n teeth co-operating with said finger in order for said first optical device to progress by an angular position in each revolution of said movable drive member, and said two movable members further comprise on the peripheries thereof means for permitting free rotary movement of said movable drive member and for preventing rotary movement of said movable detection member outside of the phases of being driven by said finger.

4. A watch according to claim 1 wherein said frequency generator supplies a first periodic signal to cause said hand to perform said p steps per revolution and a second periodic signal, said delivering means comprise means for assigning a first value to the signal supplied by said detector when said movable member occupies the position corresponding to the reference position, and a second value in the other situations, and means for memorizing two successive values of said signal when said emitter is supplied, the drive in respect of said movable detection member by said movable drive member to go from an angular position to the following angular position requires x steps of the motor; said watch further comprising means for detecting, in response to the first periodic signal, a first time at which said hand is normally to move through said reference position and a second time preceding said first time by x periods of said first signal, means for supplying said emitter at said two times, means for comparing the two memorized values corresponding to said two times to a pair of predetermined values corresponding to the actual movement of said hand through the reference position, means for applying said second periodic signal to said motor means in place of said first periodic signal if said two memorized values are different from said pair of predetermined values, means for supplying said emitter every x periods of said second periodic signal if said second periodic signal is applied to said motor means, and means for re-supplying said motor means with said first periodic signal when the last two memorized values corresponding to the times at which said emitter is fed, are identical to said pair of predetermined values.

5. A watch according to claim 4 wherein said first and second periodic signals have different frequencies the frequency of said second signal being higher than the frequency of the first signal.

6. A watch according to claim 1 comprising a first hand performing p steps per revolution, and a second hand performing one revolution when said first hand performs a plurality of revolutions wherein said detecting means further comprises a supplementary movable detection member mounted pivotally about the same axis as said detection member, and co-operating with said gear train for performing one revolution when said second hand performs m revolutions ($1<m<3$), said supplementary detection member being provided with a third optical device for said light detecting means receives at least a part of said light beam only when both said first optical means is in those of said n positions corresponding to said at least one reference position of said first hand, and said third optical means is in a position corresponding to an optical relationship with said first optical means.

7. A watch according to claim 6 wherein said first hand is the minutes hand and said second hand is the hours hand.

* * * * *